US006491566B2

(12) United States Patent
Peters et al.

(10) Patent No.: US 6,491,566 B2
(45) Date of Patent: Dec. 10, 2002

(54) SETS OF TOY ROBOTS ADAPTED TO ACT IN CONCERT, SOFTWARE AND METHODS OF PLAYING WITH THE SAME

(75) Inventors: Geoffrey W. Peters, Hillsboro, OR (US); Aaron B. Weast, West Linn, OR (US)

(73) Assignee: Intel Corporation, Santa Clara, CA (US)

( * ) Notice: Subject to any disclaimer, the term of this patent is extended or adjusted under 35 U.S.C. 154(b) by 30 days.

(21) Appl. No.: 09/817,707

(22) Filed: Mar. 26, 2001

(65) Prior Publication Data

US 2002/0137427 A1 Sep. 26, 2002

(51) Int. Cl.[7] ..... A63H 30/00
(52) U.S. Cl. ..... 446/454; 463/58
(58) Field of Search ..... 463/1, 58; 446/454–456

(56) References Cited

U.S. PATENT DOCUMENTS 4,938,483 A * 7/1990 Yavetz ..... 273/454
5,100,153 A * 3/1992 Welte ..... 124/29
5,636,994 A * 6/1997 Tong ..... 434/308
5,697,829 A * 12/1997 Chainani et al. ..... 318/568.12
5,766,077 A * 6/1998 Hongo ..... 273/148 B
6,247,994 B1 * 6/2001 DeAngelis et al. ..... 446/454
6,254,486 B1 * 7/2001 Mathieu et al. ..... 446/175
6,280,286 B1 * 8/2001 Andrews ..... 446/269
6,289,263 B1 * 9/2001 Mukherjee ..... 7000/245
6,290,565 B1 * 9/2001 Galyean, III et al. ... 273/148 B

* cited by examiner

*Primary Examiner*—Jessica Harrison
*Assistant Examiner*—John M Hotaling, II
(74) *Attorney, Agent, or Firm*—Blakely, Sokoloff, Taylor & Zafman LLP

(57) ABSTRACT

Toy robots are provided that act in concert with each other. A player issues high level team commands to a processor. The processor interprets the team command to derive individual low level commands for the toy robots. A transmitter transmits the low level commands to the toy robots, which then act in concert.

45 Claims, 4 Drawing Sheets

SETS OF TOY ROBOTS ADAPTED TO ACT IN CONCERT, SOFTWARE AND METHODS OF PLAYING WITH THE SAME

BACKGROUND OF THE INVENTION

1. Field of the Invention

The present invention is related to the field of toys, and more specifically to sets of remotely controlled toy robots and methods of playing with the same.

2. Description of the Related Art

Robots may be used as toys. A child may control a toy robot, and have it perform various tasks, such as movements. It is difficult, however, for any one person to control many toy robots at once.

DETAILED DESCRIPTION OF THE PREFERRED EMBODIMENT(S)

The present invention provides sets of toy robots and optionally also related devices. Briefly, the toy robots are adapted to act in concert with each other, in response to high level team commands. These commands may be advantageously brief.

According to the invention, a processor may be given a single team command, out of which it may derive individual low level commands for some of the toy robots. In addition, a transmitter may transmit the low level commands to these toy robots. These toy robots then act in concert.

An advantage of the invention is that the user only has to issue team commands at the high level, without being bogged down with having to make low level decisions for each toy robot, or implement them. Thus the user who plays with them may concentrate on higher level decisions, such as strategy, with better overall results for the entire set.

The invention is now described in more detail.

Figure 1:
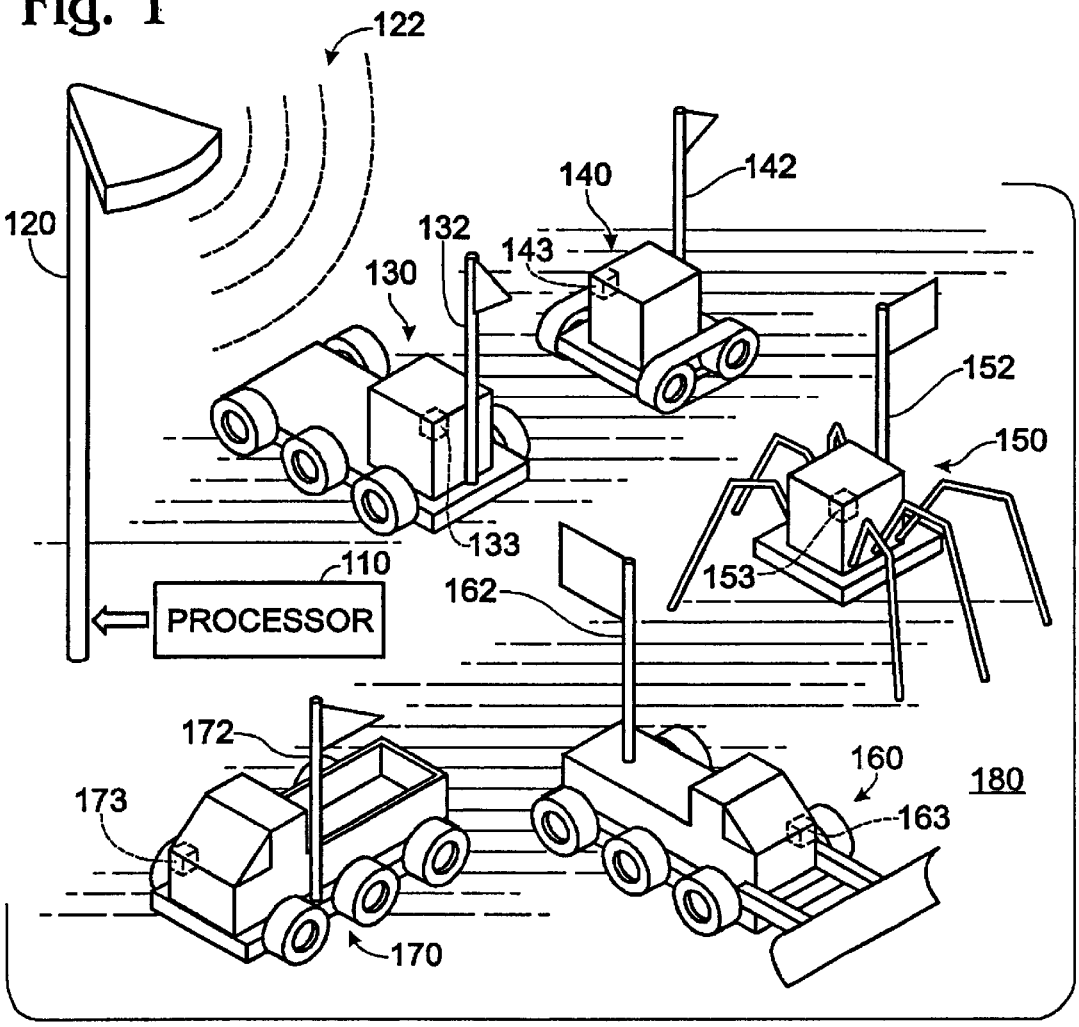
FIG. 1 is a perspective view of components of a set according to an embodiment of the invention.

Referring now to FIG. 1, a set according to an embodiment of the invention includes a processor 110, which is also known as a team control processor 110. Processor 1 10 may be provided in a personal computer (not shown in FIG. 1), or a custom-made controller (not shown in FIG. 1), although the invention is not limited in that regard. Processor 110 is adapted to receive a team command, and to derive different pawn control instructions from the team command.

In other embodiments, a controller (not shown in FIG. 1) may be included. The controller may be a stand-alone unit, distinct from the personal computer. The controller may be adapted to be coupled to a personal computer, although the invention is not limited in that regard. The processor 110 may be either in the personal computer, or in the controller.

The set of FIG. 1 additionally includes a team transmitter 120. Although the set made according to the invention may include a number of transmitters, team transmitter 120 is to be distinguished from others. Team transmitter 120 is adapted to transmit wirelessly the pawn control instructions derived by processor 110. More specifically, team transmitter 120 is adapted to transmit signals that encode these pawn control instructions. Accordingly, team transmitter 120 is adapted to receive inputs from processor 110. As such, if the processor 110 is part of a personal computer, team transmitter 120 is adapted to be coupled to the personal computer. In the event that a separate, stand alone controller is included in the set, team transmitter 120 is adapted to be coupled to the controller.

Transmission may be by any way known in the art. In one embodiment, team transmitter 120 has an infrared light source, to transmit by infrared light. In another embodiment, team transmitter 120 has a source for generating and transmitting radio frequency (RF) waves 122, which are also known as wireless or radio waves 122. In a yet another embodiment, team transmitter 120 includes a speaker, to transmit by sound waves.

The set of FIG. 1 also includes pawn toy robots 130, 140, 150, 160, 170, which are also known as pawn robotic toys. Pawn toy robots 130, 140, 150, 160, 170 have sensors 132, 142, 152, 162, 172 respectively, to receive their corresponding pawn control signals. Sensors 132, 142, 152, 162, 172 are shown as including antennas, and that is to better receive waves 122 from team transmitter 120. The invention is not limited in that regard, however, and sensors 132, 142, 152, 162, 172 may be infrared light sensors, sound sensors, etc.

Each one of sensors 132, 142, 152, 162, 172 may receive more than the one pawn control signal that corresponds to its host pawn toy robot. A potential ambiguity may be resolved, however, by the decoder that is described below.

Each pawn toy robot 130, 140, 150, 160, 170 also includes a decoder (not shown separately), which is adapted to decode the pawn control signal received by its associated sensor 132, 142, 152, 162, 172, respectively. Decoding the pawn control signal reproduces the respective pawn control instruction.

Each pawn toy robot 130, 140, 150, 160, 170 is adapted to act responsive to the reproduced pawn control instruction.

In one set of embodiments, pawn toy robots 130, 140, 150, 160, 170 are adapted to place on a play surface 180. In some of these embodiments, one of the received pawn control instructions includes an instruction for a direction of movement along the play surface 180. In others of these embodiments, one of the pawn control instructions includes an instruction for a speed of movement on the play surface 180. In yet others of these embodiments, one of the pawn control instructions includes an instruction for a desired position on the play surface 180. Such instructions that are with respect to the play surface 180 may be given in terms of coordinates of the play surface 180.

One of the pawn toy robots 130, 140, 150, 160, 170 in addition may have a status sensor (not shown separately), although the invention is not limited in that regard. The status sensor is adapted to sense whether a preset pawn status condition is met. The preset pawn status condition may be an orientation condition, for example determining whether the subject pawn toy robot has been accidentally tipped over. Or it may be a location condition, for example determining whether the subject toy robot has exceeded allowable range limits of the play surface 180.

Furthermore, one of the pawn toy robots 130, 140, 150, 160, 170 may have a preset routine to execute, if the preset pawn status condition is met. For example, if the subject pawn toy robot has been tipped over, a mechanism may be engaged for returning it to an upright orientation. If the subject pawn toy robot has exceeded an allowable range limit, the preset action routine may be defined as reversing its latest movement. Optionally, the preset action routine may be adapted to override the reproduced upon control instruction, if the preset pawn status condition is met.

In another embodiment, the preset pawn status condition may be in proximity to a location, or to a specific pawn toy robot. The proximity may be detected by additional structure in the pawn toy robot, such as the later described RFID tag. For example, pawn toy robot 160, which is in the shape of a front loader, may be provided to work together with pawn toy robot 170, which is in the shape of a dump truck. When pawn toy robot 160 detects pawn toy robot 170 in its vicinity, then pawn toy robot 160 may raise its front loader.

Figure 2:
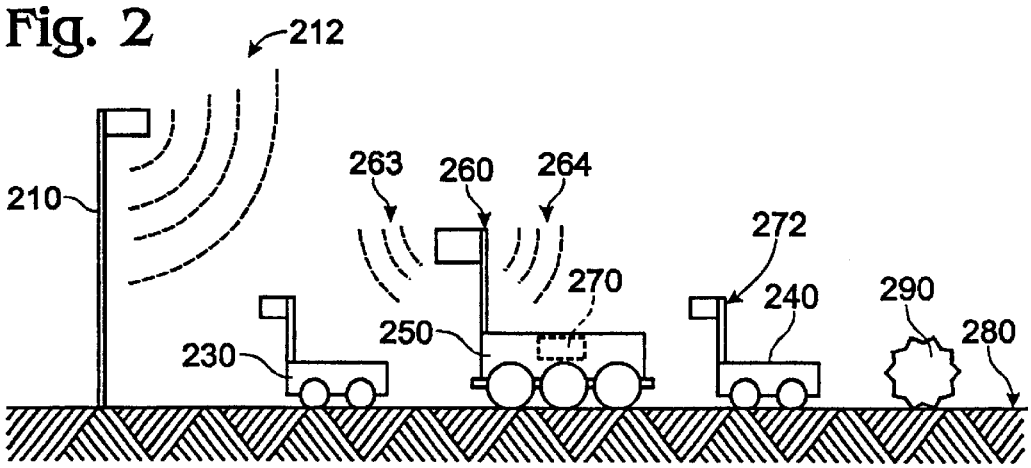
FIG. 2 is a side view of components of a set made according to another embodiment of the invention.

Referring now to FIG. 2, another set according to the invention is described. The set includes a transmitter 210 that emits a signal 212. The set also includes two pawn toy robots 230, 240. It should be noted that the transmitter 210 is not necessarily the team transmitter for these two pawn toy robots 230, 240.

The set of FIG. 2 also includes a master toy robot 250. Master toy robot 250 includes team transmitter 260, shown in the embodiment of FIG. 2 as a bidirectional antenna 260. Master toy robot 250 receives the master signal 212.

In the set of embodiments shown in FIG. 2, a team control processor 270 is carried on the master toy robot 250. Signal 212 is a master signal, which encodes the team command. Team control processor 270 decodes the team command out of master signal 212. Team control processor 270 then derives the individual pawn control instructions from the team command, one pawn control instruction for each of pawn toy robots 230, 240. Team transmitter 260 transmits pawn control signals 263, 264 that encode the pawn control instructions for pawn toy robots 230, 240, respectively. Pawn control signals 263, 264 are different from each other according to the invention, as they encode different pawn control instructions.

In another set of embodiments, the team control processor derives the individual pawn control instructions. The pawn control signals are then transmitted from transmitter 210 to master toy robot 250. Then master toy robot 250 retransmits the pawn control signals 263, 264 to the individual pawn toy robots 230, 240. In that sense, both antennas 210 and 260 act as team transmitters.

Master toy robot 250 may act as a chief of the team of toy robots 230, 240, 250. When it is included, transmitter 260 may be of lesser power than transmitter 210, which results in energy savings. In addition, transmitter 260 may be of a different type than transmitter 210.

As in FIG. 1, also in FIG. 2, toy robots 230, 240, 250 may be adapted to place on a surface 280. Surface 280 may be flat, suitable for toy robots 230, 240 and 250 to move around on.

The set of FIG. 2 optionally also includes a game ball 290, although the invention is not limited in that regard. When provided, the game ball 290 is adapted to be manipulated by at least one of the pawn toy robots 230, 240, 250. Manipulation may be by pushing the game ball 290.

Game ball 290 may have a smooth surface, and be spherical. That is not necessarily the case, however, and the game ball 290 may have edges on its surface. This could prevent it from rolling too much, if such is undesirable. Too much rolling could be undesirable in a number of circumstances, for example if surface 280 cannot be guaranteed to be level.

In other embodiments, at least one of the pawn toy robots 230 and 240 may include a beacon. The beacon may include the light emitting diode (LED), or a speaker, or a source for waves. In the embodiment of FIG. 2, antenna 272 of pawn toy robot 240 also acts as a beacon. The beacon transmits a pawn status signal, as to the status of pawn toy robot 240. The status of pawn toy robot 240 may be learned from the above described status sensor, if one has been provided. In some embodiments, the pawn status signal may be further responsive to the pawn control signal 264, although the invention is not limited in that regard.

A set made according to the invention may also include a feedback sensor to receive the pawn status signal. In the embodiment of FIG. 2, the feedback sensor is antenna 260 of master toy robot 250. In other embodiments of the invention that are described below, where an arena is delineated, a feedback sensor may be outside the arena.

Figure 3:
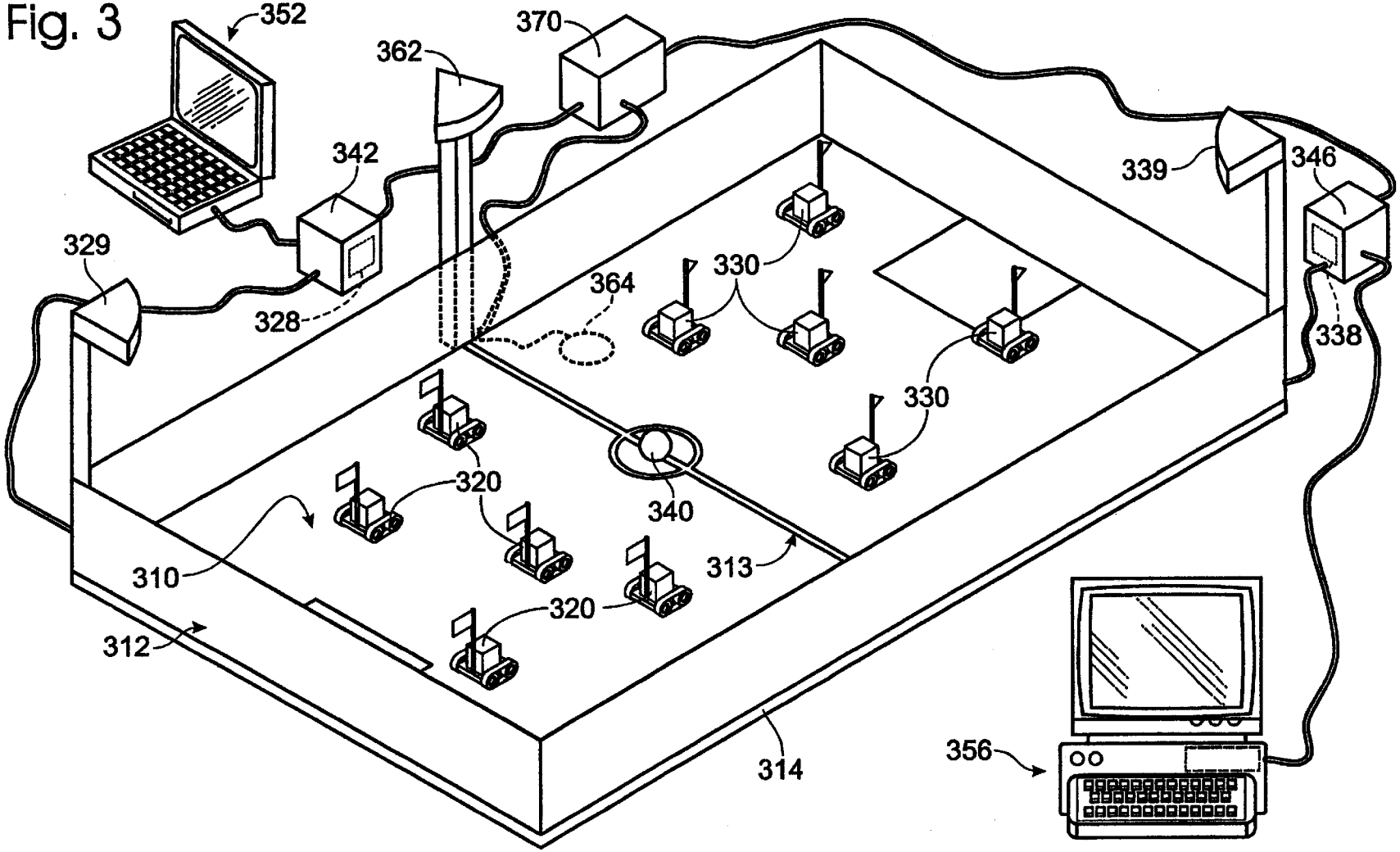
FIG. 3 is a perspective view of components of a set according to one more embodiment of the invention.

Referring now to FIG. 3, a set according to another embodiment of the invention is described.

The set of FIG. 3 optionally includes a play surface 310, although the invention does not require that play surface 310 be included with a set although that is not required either. Additionally, an optional enclosure 312 may delineate an arena of the play surface 310. In the embodiment of FIG. 3, the arena is in the shape of the play soccer field, and includes suitable demarcations 313.

Alternately, the set of FIG. 3 may include an entire play device 314, which includes the play surface 310. Providing play device 314 has an advantage that an arena may be delineated in advance, with or without an enclosure, such as enclosure 312. Other advantages of providing play device 314 as part of the set will be understood below.

The set of FIG. 3 also includes a number of first pawn toy robots 320. Pawn toy robots 320 are intended to form a first team. They are adapted to place on the play surface 310, and adapted to move on it according to first pawn control instructions. If an arena is delineated out of the play surface 310, they are adapted to be placed and move on the arena.

The set of FIG. 3 additionally includes a number of second pawn toy robots 330. Pawn toy robots 330 are intended to form a second team, which may play against the first team. Pawn toy robots 330 are similarly adapted to place on the play surface 310, and adapted to move on it according to second pawn control instructions.

In one embodiment, the members of the different teams are painted different colors, for distinguishing. In another embodiment, the members of the different teams carry flags at the top of antennas. The flags may have the color of the team, or the shape of the team, etc. Many such distinguishing methods may be employed simultaneously, given that the members of the team need to be distinguished by the players, and sometimes also by the team control processors that are described below.

The set of FIG. 3 is shown to further include a game ball 340, although the invention is not limited in that regard. The game ball 340 may be made as described in connection with game ball 290 of FIG. 2.

Pawn toy robots 320 and 330 may be of any size. In an embodiment, where they are very small, such as one inch long, they are called crickets or robocrickets. In any event, their size may be commensurate with the size of the arena.

The set of FIG. 3 also includes a first team control processor 328. Team control processor 328 may be adapted to receive a first team command, and to derive from it first pawn control instructions, one for each of the first pawn toy robots 320.

The set of FIG. 3 may also include a first team transmitter 329. Transmitter 329 is adapted to transmit to the first pawn toy robots 320 first pawn control signals, which encode the first pawn control instructions derived by first team control processor 328.

The set of FIG. 3 also includes a second team control processor 338. Team control processor 338 is adapted to receive a second team command, and to derive from it second pawn control instructions, one for each of second pawn toy robots 330.

The set of FIG. 3 may also include a second team transmitter 339. Transmitter 339 is adapted to transmit to the second pawn toy robots 330 second pawn control signals, which encode the second pawn control instructions derived by second team control processor 338.

In the embodiment of FIG. 3, first team control processor 328 is provided in a stand-alone controller 342 that is distinct from any personal computers. Similarly, second team control processor 338 is provided in a stand-alone controller 346. This configuration has the advantage that it permits using very fast microprocessors for the first and second team control processors 328 and 338.

In the embodiment of FIG. 3, the first team command is input in first team control processor 328 from a personal computer 352. Similarly, the second team command is input in second team control processor 338 from a personal computer 356. This is not necessary, however. In other embodiments of the present invention, controllers 342 and 346 are provided with input devices that enable issuing the first and second team commands. Such input devices may include a keyboard, a joystick, levers, switches, etc. such that a user (not shown) is able to control the pawn toy robots 320 and 330 through the controllers 342 and 346. In another embodiment, a user may control one of the toy robots 320 or 330 using software running on the personal computer 352 or 356 while the controller 342 controls the remaining toy robots 320 or 330. In another embodiment, some or all of the robots 320 or 330 may be able to communicate amongst themselves and react to a variety of stimuli without an external control device such as the personal computer 352 or 356 or controllers 342 or 346.

The advantage of providing the set as shown in FIG. 3 is that built-in devices of personal computers 352 and 356 may be used by the set, thus keeping down the overall cost of the set. Such built-in devices of personal computers 352 and 356 are the screen for providing feedback, a keyboard for entering team commands, a mouse for entering the team commands via a graphical user interface, etc.

In any event, a first player (not shown) will use either the first personal computer 352 or the first controller 342, to issue the first team commands. In addition, the second player (not shown) uses either the second personal computer 356, or the second controller 346 to issue the second team commands. The first team transmitter 329 and the second team transmitter 339 will take the first and second team commands to the pawn toy robots 320 and 330, respectively, in the arena.

The set of FIG. 3 also includes a field sensor 362. Field sensor 362 is adapted to sense the locations of the first pawn toy robots 320 and the second pawn toy robots 330 in the arena. Field sensor 362 may be made in any way known in the art, and many such ways will become apparent in view of the present description. In one set of embodiments, field sensor 362 may be the feedback sensor that receives the pawn status signal. In that case, field sensor 362 may be a wireless wave (radio frequency) detector. In another set of embodiments, field sensor 362 may be a camera. If the pawn toy robots do not emit a pawn status signal, they may be painted different colors. Moreover, many such cameras may be used, and more and different field sensors may be used.

In addition, game ball 340 could be painted a yet different color. Or game ball 340 may contain a radio frequency identification (RFID) tag (not shown).

The set of FIG. 3 also includes another field sensor 364. Field sensor 364 may be an electrical coil that may serve as a RFID tag reader. In that case, at least one of the pawn toy robots 320 and 330 would include an RFID tag (not shown). The RFID tag may be either customized to each pawn toy robot, or by team. In another embodiment, it may be a mere magnet that causes field sensor 364 to generate an electrical signal every time one of the moving pawn toy robots moves across it.

The set of the embodiment of FIG. 3 also includes a control unit 370. Control unit 370 receives inputs from field sensor 362 and field sensor 364. This way, control unit 370 may send these inputs to first and second team control processors 328 and 338. This way, processors 328 and 338 know where the pawn toy robots 320 and 330 are with respect to the arena. This knowledge permits processors 328 and 338 to derive more finely tuned individual pawn control instructions, than if the knowledge were not provided. Providing this benefit is made possible by including play device 314 as part of the set.

In the embodiment of FIG. 3, a master toy robot is provided for either team. In other embodiments a master toy robot is not provided. The locations of pawn toy robots may be in terms relative to the master toy robot, not in terms relative to the absolute coordinates of an arena.

It is readily apparent that the present invention may be implemented by one or more devices that include logic circuitry. It may also be implemented by a device that includes a dedicated processor system, that may include a microcontroller or a microprocessor.

The invention additionally provides methods, which are described below. Moreover, the invention provides apparatus that performs, or assists in performing the methods of the invention. This apparatus may be specially constructed for the required purposes, or it may comprise a general-purpose computer selectively activated or reconfigured by a computer program stored in the computer. The methods and algorithms presented herein are not necessarily inherently related to any particular computer or other apparatus. In particular, various general-purpose machines may be used with programs in accordance with the teachings herein, or it may prove more convenient to construct more specialized apparatus to perform the required method steps. The required structure for a variety of these machines will appear from this description. Useful machines or articles for performing the operations of the present invention include general-purpose digital computers or other similar devices. In all cases, there should be borne in mind the distinction between the method of operating a computer and the method of computation itself. The present invention relates also to method steps for operating a computer and for processing electrical or other physical signals to generate other desired physical signals.

The invention additionally provides a program, and a method of operation of the program. The program is most advantageously implemented as a program for a computing machine, such as a general purpose computer, a special purpose computer, a microprocessor, etc.

The invention also provides a storage medium that has the program of the invention stored thereon. The storage medium is a computer-readable medium, such as a memory, and is read by the computing machine mentioned above.

A program is generally defined as a sequence of steps leading to a desired result. These steps, also known as instructions, are those requiring physical manipulations of physical quantities. Usually, though not necessarily, these quantities take the form of electrical or magnetic signals capable of being stored, transferred, combined, compared, and otherwise manipulated or processed. When stored, they may be stored in any computer-readable medium. It is convenient at times, principally for reasons of common usage, to refer to these signals as bits, data bits, samples, values, elements, symbols, characters, images, terms, numbers, or the like. It should be borne in mind, however, that all of these and similar terms are associated with the appropriate physical quantities, and that these terms are merely convenient labels applied to these physical quantities. This detailed description is presented largely in terms of flowcharts, display images, algorithms, and symbolic representations of operations of data bits within a computer readable medium, such as a memory. Such descriptions and representations are the type of convenient labels used by those skilled in programming and/or the data processing arts to effectively convey the substance of their work to others skilled in the art. A person skilled in the art of programming may use this description to readily generate specific instructions for implementing a program according to the present invention. For the sake of economy, however, flowcharts used to describe methods of the invention are not repeated in this document for describing software according to the invention.

Often, for the sake of convenience only, it is preferred to implement and describe a program as various interconnected distinct software modules or features, collectively also known as software. This is not necessary, however, and there may be cases where modules are equivalently aggregated into a single program with unclear boundaries. In any event, the software modules or features of the present invention may be implemented by themselves, or in combination with others. Even though it is said that the program may be stored in a computer-readable medium, it should be clear to a person skilled in the art that it need not be a single memory, or even a single machine. Various portions, modules or features of it may reside in separate memories, or even separate machines. The separate machines may be connected directly, or through a network, such as a local access network (LAN), or a global network, such as the Internet.

In the present case, methods of the invention are implemented by machine operations. In other words, embodiments of the program of the invention are made such that they perform methods of the invention that are described in this document. These may be optionally performed in conjunction with one or more human operators performing some, but not all of them. As per the above, the users need not be collocated with each other, but each only with a machine that houses a portion of the program. Alternately, some of these machines may operate automatically, without users and/or independently from each other.

Methods of the invention are now described.

Figure 4:
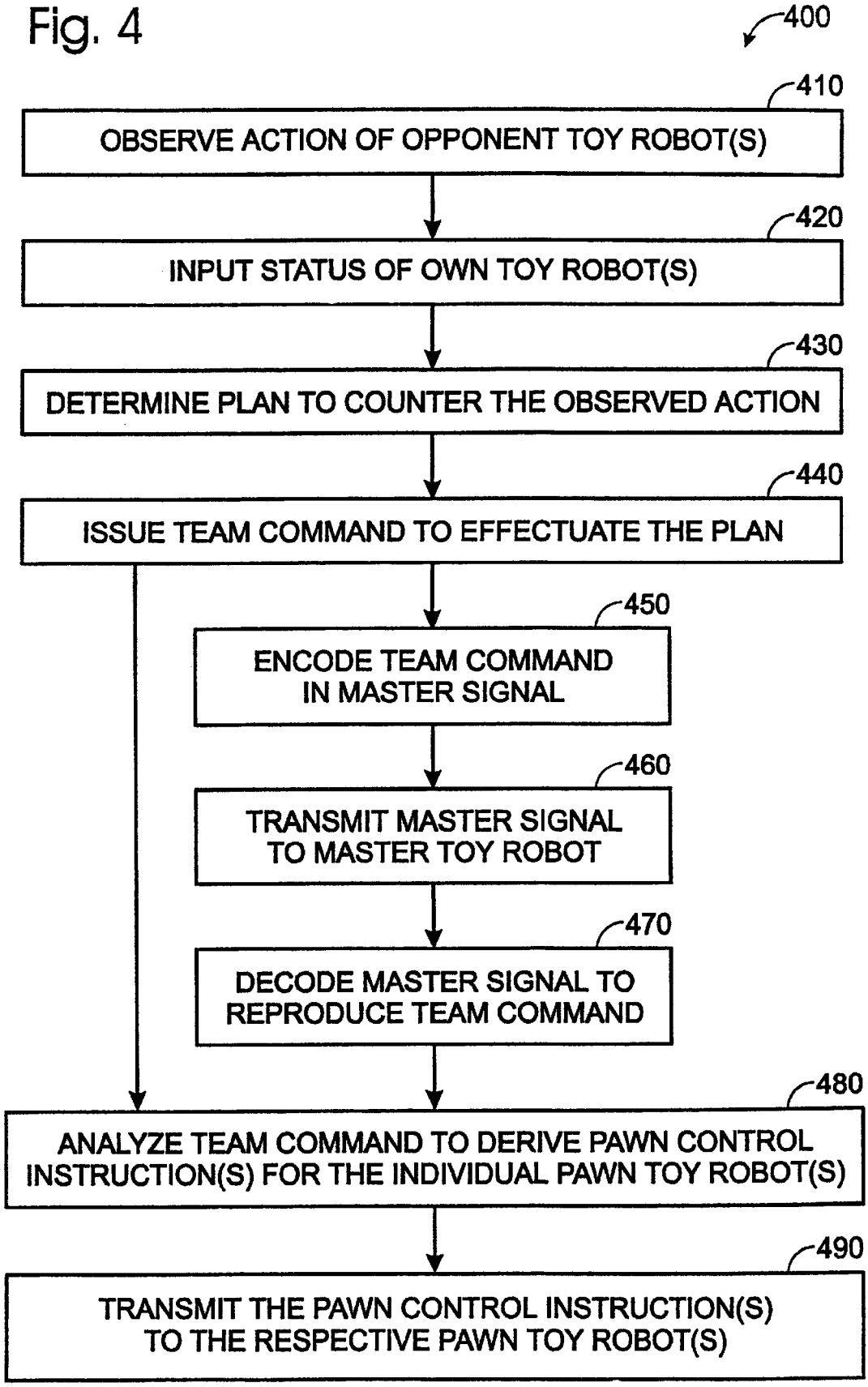
FIG. 4 is a flowchart illustrating a general method according to an embodiment of the invention.

Referring now to FIG. 4, a flowchart 400 is used to describe a general method according to embodiments of the invention.

According to a box 410, an action of at least one opponent toy robot is observed by one of the players. The opponent toy robot may be toy robot in opponent team. It may be either a pawn toy robot or a master toy robot.

According to an optional box 420, a status is input of the player's own toy robots, although the invention is not limited in that regard. This is performed better if there is feedback as to the status of the player's own toy robots. Alternately, the player may derive such feedback by looking at the arena. The inputted status conveys the positions of the player's own toy robots, their availability, etc.

According to a next box 430, a plan is determined to counter the observed action. This may be performed by the player. If the status has been input according to box 420, then the status may also be taken into account for determining the plan.

According to a next box 440, a team command is issued to effectuate the plan. The team command may be laconic, such as "All Advance", "Left-group Retreat", etc.

According to an optional next box 450, the issued team command is encoded in a master signal. According to an optional next box 460, the master signal is transmitted to a master toy robot. According to an optional next box 470, the master signal is decoded to reproduce the team command.

According to a next box 480, the team command is analyzed to derive pawn control instructions. The analysis of the team command is performed by a team processor. If boxes 450, 460, and 470 have taken place, then the team processor is on board the master toy robot. Alternately, execution may move directly from box 440 to box 480.

The pawn control instructions are individualized for pawn toy robots of the same team. They are configured such that, while each pawn toy robot acts individually, they all act in concert. For example, the pawn toy robots may be adapted to be placed on a play surface. In that case, one of the pawn control instructions includes an instruction for either a direction of movement, or a speed of movement, or a desired position on the play surface of the pawn toy robot, or any combination of the above.

The pawn control instructions may take into account a status of each pawn toy robot, if that is known, although the invention is not limited in that regard. The status of each pawn toy robot would be known from its status signal, input from a field sensor if one is provided, etc.

According to a next box 490, the pawn control instructions are transmitted to the respective pawn toy robots. This may be performed wirelessly, by first encoding each pawn control instruction into a respective pawn control signal, and then transmitting the pawn control signal to the respective pawn toy robot. The pawn toy robot may then decode the pawn control instruction out of the pawn control signal.

Figure 5:
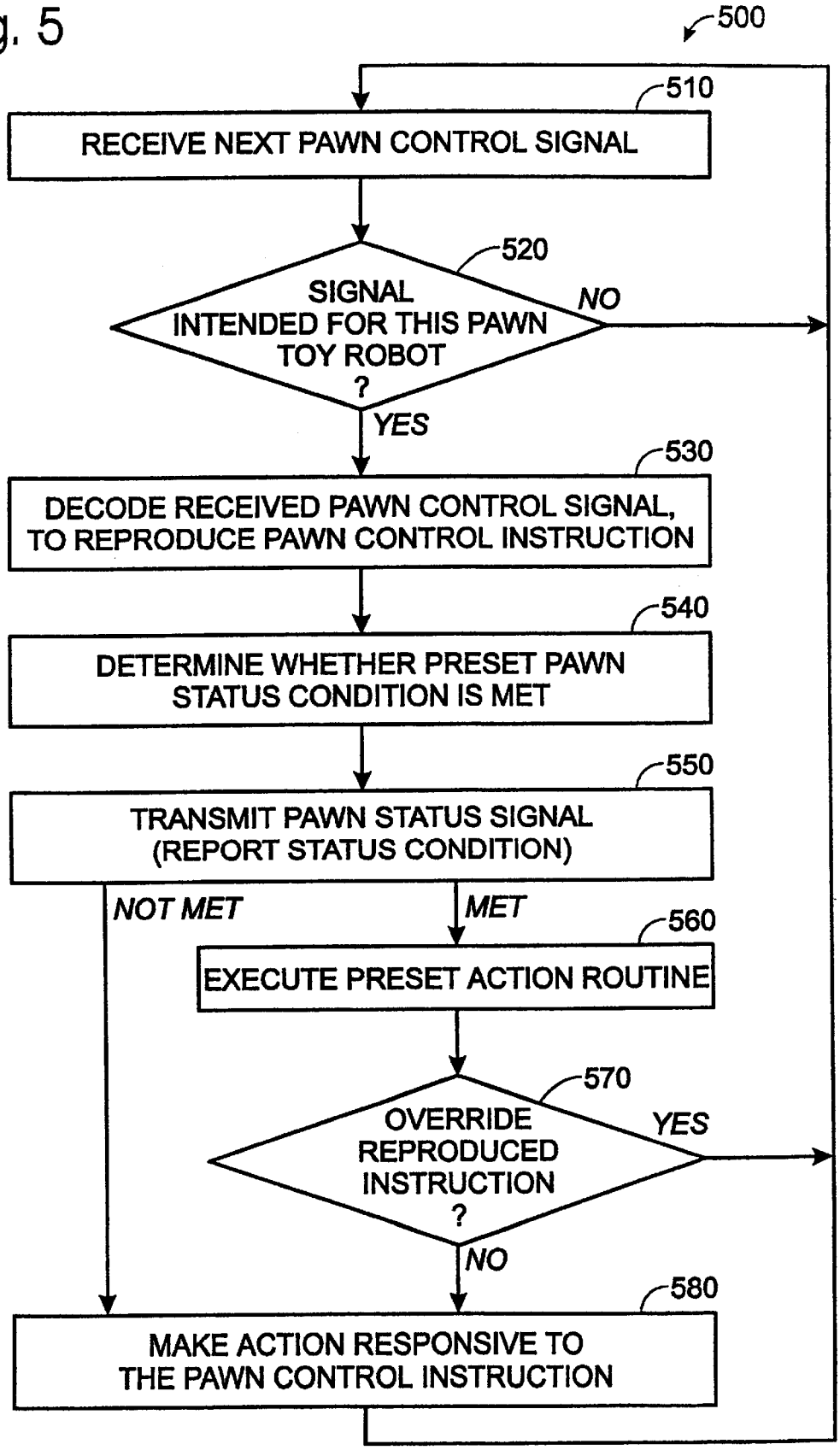
FIG. 5 is a flowchart illustrating an optional method of an individual pawn toy robot according to an embodiment of the invention.

Referring now to FIG. 5, a flowchart 500 is used to illustrate a method according to another embodiment of the invention. It will be appreciated that the method of flowchart 500 may be performed by many pawn toy robots simultaneously.

According to box 510, a next pawn control signal is received.

According to a next box 520, it is determined whether the received pawn control signal is intended for the pawn toy robot that received it. If not, execution returns to box 510.

According to a next box 530, the received pawn control signal is decoded to reproduce the pawn control instruction. It will be apparent that the order of box 520 and box 530 may be equivalently inverted.

According to a next box 540, it is determined whether a preset pawn status condition is met.

According to a next box 550, a pawn status signal is transmitted. The pawn status signal may be used to report the determined pawn status condition.

If the preset pawn status condition is met at box 540, then according to a box 560 following box 550, the preset action routine may be executed. According to a next box 570, it is determined whether the preset action routine is programmed to override the reproduce instruction. If yes, the execution returns to box 510.

If not, or if the preset pawn status condition is not met at box 540, then according to box 580, the pawn toy robot makes an action responsive to the pawn control instruction. The action may be movement in the arena, although the invention is not limited in that regard.

A person skilled in the art will be able to practice the present invention in view of the description present in this document, which is to be taken as a whole. Numerous details have been set forth in order to provide a more thorough understanding of the invention. In other instances, well-known features have not been described in detail in order not to obscure unnecessarily the invention.

While the invention has been disclosed in its preferred form, the specific embodiments thereof as disclosed and illustrated herein are not to be considered in a limiting sense. Indeed, it should be readily apparent to those skilled in the art in view of the present description that the invention may be modified in numerous ways. The inventor regards the subject matter of the invention to include all combinations and subcombinations of the various elements, features, functions and/or properties disclosed herein.

The following claims define certain combinations and subcombinations, which are regarded as novel and non-obvious. Additional claims for other combinations and subcombinations of features, functions, elements and/or properties may be presented in this or a related document.

The invention claimed is:

1. A set comprising:

a team control processor adapted to receive a team command and to derive at least a first and a second distinct pawn control instructions from the team command;

a team transmitter adapted to transmit wirelessly at least a first and a second distinct pawn control signals encoding respectively the first and second pawn control instructions; and at least a first and a second pawn toy robots, the first pawn toy robot having a sensor to receive the first pawn control signal, the second pawn toy robot having a primary sensor to receive the second pawn control signal, each pawn toy robot further having a decoder to adapted to decode the pawn control signal received by the associated primary sensor to reproduce the respective pawn control instruction, each pawn toy robot being adapted to act responsive to the reproduced pawn control instruction.

2. The set of claim 1, wherein the first and second pawn toy robots are adapted to place on a play surface, and one of the received pawn control instructions includes an instruction for one of a direction of movement, speed of movement, and desired position on the play surface of the pawn toy robot to which the pawn control instruction is to be transmitted.

3. The set of claim 1, wherein the team control processor is in a personal computer.

4. The set of claim 1, wherein.

the team transmitter is adapted to be coupled to a personal computer.

5. The set of claim 1, further comprising:

a stand alone controller distinct from a personal computer, wherein the team transmitter is adapted to be coupled to the controller.

6. The set of claim 5, wherein the controller is adapted to be coupled to a personal computer.

7. The set of claim 1, wherein the team transmitter includes one of an infrared light source, a radio frequency wave source, and a speaker.

8. The set of claim 1, further comprising:

a field sensor adapted to sense a location of at least one of the pawn toy robots.

9. The set of claim 8, wherein at least one of the pawn toy robots includes an RFID tag, and the field sensor is a RFID tag reader.

10. The set of claim 8, wherein the team control processor receives inputs from the field sensor.

11. The set of claim 1, wherein at least one of the pawn toy robots includes a beacon to transmit a pawn status signal.

12. The set of claim 11, wherein the beacon includes one of a LED, a speaker, and a source for radio frequency waves.

13. The set of claim 11, wherein the pawn status signal is responsive to the pawn control signal.

14. The set of claim 11, further comprising:

a feedback sensor to receive the pawn status signal.

15. The set of claim 11, wherein the feedback sensor is included in one of the toy robots.

16. The set of claim 1, wherein at least one of the pawn toy robots includes a status sensor adapted to sense whether a preset pawn status condition is met, and a preset action routine to execute if the preset pawn status condition is met.

17. The set of claim 16, wherein the preset action routine is adapted to override the reproduced pawn control instruction if the preset pawn status condition is met.

18. The set of claim 16, wherein the preset pawn status condition is one of an orientation condition, a location condition and a proximity condition.

19. The set of claim 1, further comprising:

a master toy robot that has the transmitter.

20. The set of claim 19, wherein the master toy robot has a master sensor to receive a master control signal that encodes the team command, and the team control processor.

21. A set comprising:

a first team control processor adapted to receive a first team command and to derive from the first team command a plurality of first pawn control instructions;

a first team of a plurality of first pawn toy robots to place on a play surface, each first pawn toy robot adapted to move according to the first pawn control instructions;

a second team control processor adapted to receive a second team command and to derive from the second team command a plurality of second pawn control instructions; and a second team of a plurality of second pawn toy robots to place on the play surface, each second pawn toy robot adapted to move according to the second pawn control instructions.

22. The set of claim 21, further comprising:

a first team transmitter adapted to transmit to the first pawn toy robots a plurality of first pawn control signals that encode respectively the derived first pawn control instructions; and a second team transmitter adapted to transmit to the second pawn toy robots a plurality of second pawn, control signals that encode respectively the derived second pawn control instructions.

23. The set of claim 21, further comprising:

an enclosure to delineate an arena on the play surface, wherein the first pawn toy robots and the second pawn toy robots are to be placed in the arena.

24. The set of claim 21, further comprising:

a play device that includes the play surface.

25. The set of claim 21, wherein an arena is delineated on the play surface.

26. The set of claim 21, further comprising:

a game ball adapted to be placed on the play surface, and to be manipulated by at least one of the pawn toy robots.

27. The set of claim 21, further comprising:

a first master toy robot to place on the play surface, the master toy robot having the first transmitter.

28. An article comprising: a storage medium, said storage medium having stored thereon instructions, that, when executed by at least one device, result in:

deriving a first and a second distinct pawn control instructions from a team command;

transmitting wirelessly to a first pawn toy robot a first pawn control signal encoding the first pawn control instruction; and transmitting wirelessly to a second pawn toy robot a second pawn control signal encoding the second pawn control instruction.

29. The article of claim 28, wherein the instructions further result in:

the first and second pawn toy robots are adapted to place on a play surface, and one of the received pawn control instructions includes an instruction for one of a direction of movement, speed of movement, and desired position on the play surface of the pawn toy robot to which the pawn control instruction is to be transmitted.

30. The article of claim 28, wherein the instructions further result in:

encoding the team command in master signal; and transmitting the master signal to master toy robot.

31. The article of claim 30, wherein the instructions further result in:

decoding the master signal to reproduce the team command prior to deriving.

32. A method comprising:

deriving a first and a second distinct pawn control instructions from a team command;

transmitting wirelessly to a first pawn toy robot a first pawn control signal encoding the first pawn control instruction; and transmitting wirelessly to a second pawn toy robot a second pawn control signal encoding the second pawn control instruction.

33. The method of claim 32, wherein the first and second pawn toy robots are adapted to place on a play surface, and one of the received pawn control instructions includes an instruction for one of a direction of movement, speed of movement, and desired position on the play surface of the pawn toy robot to which the pawn control instruction is to be transmitted.

34. The method of claim 32, further comprising:

observing an action of an opponent toy robot in an opponent team;

determining a plan to counter the observed action; and prior to deriving, issuing the team command to effectuate the plan.

35. The method of claim 34, further comprising:

inputting a status of the first pawn toy robot to determine the plan.

36. The method of claim 32, further comprising:

encoding the team command in master signal; and transmitting the master signal to master toy robot.

37. The method of claim 36, further comprising:

decoding the master signal to reproduce the team command prior to deriving.

38. The method of claim 32, wherein sensing whether a preset pawn status condition is met; and if so, executing a preset action routine.

39. The method of claim 32, further comprising:

receiving the first pawn control signal;

making a first action responsive to the first pawn control instruction;

receiving the second pawn control signal; and making a second action responsive to the second pawn control instruction.

40. The method of claim 39 further comprising:

determining whether a received pawn control signal is intended for a pawn toy robot that received it.

41. The method of claim 39, further comprising: decoding the received first and second pawn control signals to reproduce the first and second pawn control instructions.

42. The method of claim 41, wherein sensing whether a preset pawn status condition is met; and if so, executing a preset action routine.

43. The method of claim 42 wherein executing the preset action routine is performed by overriding the reproduced pawn control instruction.

44. The method of claim 42, wherein the preset pawn status condition is one of an orientation condition, and a location condition.

45. The method of claim 42, further comprising:

transmitting a pawn status signal that encodes whether the preset pawn status condition is met.

* * * * *